United States Patent [19]

Adam et al.

[11] Patent Number: 4,495,115

[45] Date of Patent: Jan. 22, 1985

[54] DOWNDRAFT CARBURETOR FOR INTERNAL COMBUSTION ENGINES

[75] Inventors: Roland Adam, Stuttgart; Dieter Krauth, Waiblingen-Hohenacker; Hans-Otto Derndinger, Stuttgart, all of Fed. Rep. of Germany

[73] Assignee: Daimler-Benz AG, Fed. Rep. of Germany

[21] Appl. No.: 447,664

[22] Filed: Dec. 7, 1982

[30] Foreign Application Priority Data

Dec. 12, 1981 [DE] Fed. Rep. of Germany ..... 3149277

[51] Int. Cl.[3] ..... F02M 9/08

[52] U.S. Cl. ..... 261/44 F; 261/DIG. 18

[58] Field of Search ..... 261/44 F, 50 A, DIG. 18

[56] References Cited

U.S. PATENT DOCUMENTS

| | | | |
|---|---|---|---|
| 3,182,974 | 5/1965 | Hill | 261/44 F |
| 3,284,060 | 11/1966 | Kalert, Jr. | 261/50 A |
| 3,362,694 | 1/1968 | Gould | 261/50 A |
| 3,929,114 | 12/1975 | Chattopadhayay et al. | 261/50 A |
| 3,937,768 | 2/1976 | Bier et al. | 261/44 F |
| 3,956,434 | 5/1976 | Dickensheets et al. | 261/44 F |
| 4,058,100 | 11/1977 | Tanaka et al. | 261/50 A |

*Primary Examiner*—Tim Miles

*Attorney, Agent, or Firm*—Craig & Burns

[57] ABSTRACT

The invention refers to a downdraft carburetor for internal combustion engines, the choke tube cross-section being controlled by a choke tube valve whose movement is controlled as a function of the control pressure in the choke tube by means of a diaphragm and lever with spring support. The choke tube and the choke tube valve have the shape of a venturi nozzle. The control of the choke tube valve is so arranged that the closing moment increases with closing of the choke tube valve. A damping system is provided which consists of a diaphragm box placed in the float chamber of the carburetor and which is connected by means of levers with the levers controlling the choke tube valve.

4 Claims, 4 Drawing Figures

DOWNDRAFT CARBURETOR FOR INTERNAL COMBUSTION ENGINES

Figure 1:
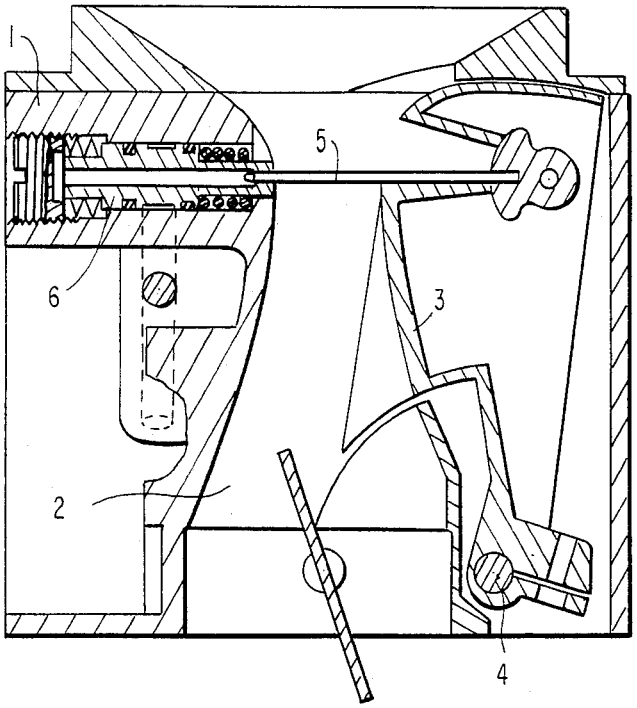

The invention refers to a downdraft carburetor for internal combustion engines, in which the cross-section of the choke tube is controlled by a choke tube valve which swivels with a shaft and forms part of the choke tube wall, this valve being actuated by a spring-loaded diaphragm via levers as a function of the control pressure in the choke tube and having attached to it the jet needle which engages in a jet carrier opposite the choke tube valve.

The invention is directed to improving a carburetor of this type, as is disclosed in a report appearing in ATZ Automobiltechnische Zeitschrift 82 (1980) 10 on pages 535 to 537, wherein attached to the diaphragm is a rod whose free end is attached to the free end of one leg of an angular lever which is rigidly connected to the shaft moving the choke tube valve. A tension spring so acts on the other leg of this angular lever that the resulting closing moment due to the spring force and the effective lever arm increases on closing the choke tube valve.

Whereas in the known carburetor, in which the closing spring acts directly on the diaphragm, the change in length of the closing spring is approximately proportional to the movement of th choke tube valve, with the result that at low airflows the closing force of the choke tube valve and thus the depression and the air velocity in the choke tube are smaller than at high airflows, the control system according to the invention achieves the result that high air velocities with good fuel atomization occur at low airflows, while the smaller pressure drop in the choke tube at high airflows mkes possible a greater power output.

In a further embodiment of the carburetor according to the invention, a damping system connected with the angular lever can be provided, this system consisting of a diaphragm box arranged in the float chamber, the internal space of the diaphragm box being connected with the float chamber by means of an orifice and a self-acting non-return valve for rapid filling of the diaphragm box with fuel.

This damping system is independent of both position and temperature. It operates without friction and no additional auxiliary material is required in operation.

One leg of an angular lever, swivellable about an axis, can advantageously engage with the diaphragm of the diaphragm box, the other leg of the angular lever being provided at its free end with teeth which engage in corresponding teeth at the free end of that leg of the angular lever moving the choke tube valve, this angular lever being connected with the rod leading to the diaphragm. The teeth can with advantage be provided with a plastic coating.

An object of the invention, therefore, is an improved downdraft carburetor for internal combustion engines.

A further object of the invention is a downdraft carburetor for internal combustion engines wherein the cross-section of the choke tube is controlled by a choke tube valve which swivels with a shaft and forms part of the choke tube wall, the valve being actuated by a spring-loaded diaphragm via levers as a function of the control pressure in the choke tube and having attached to it the jet needle which engages in a jet carrier opposite the choke tube valve. A further object of the invention is a downdraft carburetor wherein, attached to the diaphragm is a rod whose free end is attached to the free end of one leg of an angular lever which is rigidly connected to the shaft moving the choke tube valve and wherein a tension spring so acts on the other leg of the angular lever that the resulting closing moment due to the spring force and the effective lever arm increases on closing the choke tube valve.

A further object of the invention is a downdraft carburetor achieving high air velocities with good fuel atomization at low air flows while the smaller pressure drop in the choke tube at high air flows makes possible a greater power output.

A still further object of the invention is a downdraft carburetor for internal combustion engines, in which the cross-section of the choke tube is controlled by a choke tube valve which swivels with a shaft and forms part of the choke tube wall, the valve being actuated by a spring-loaded diaphragm via levers as a function of the control pressure in the choke tube and having attached to it the jet needle which engages in a jet carrier opposite the choke tube valve, wherein attached to the diaphragm is a rod whose free end is attached to the free end of one leg of an angular lever rigidly connected to the shaft moving the choke tube valve such that a tension spring so acts on the other leg of the angular lever that the resulting closing moment due to the spring force and effective lever arm increases on closing the choke tube valve.

A still further object of the invention is a downdraft carburetor wherein a damping system is connected with the angular lever, the damping system comprising a diaphragm box arranged in a float chamber, the internal space of the diaphragm box being connected with the float chamber by means of an orifice and a self-acting non-return valve for rapid filling of the diaphragm box with fuel.

Figure 2:
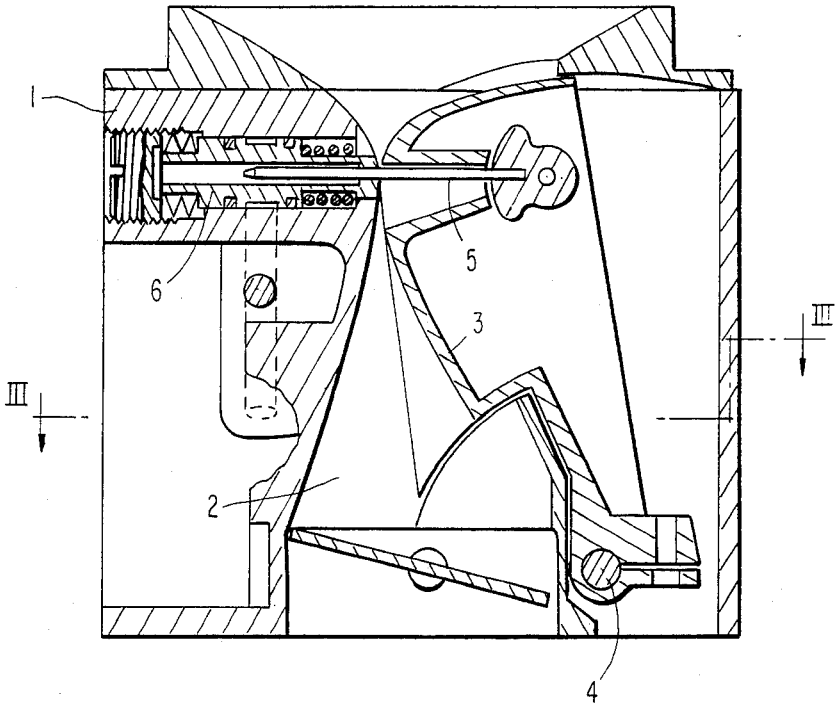
Figure 3:
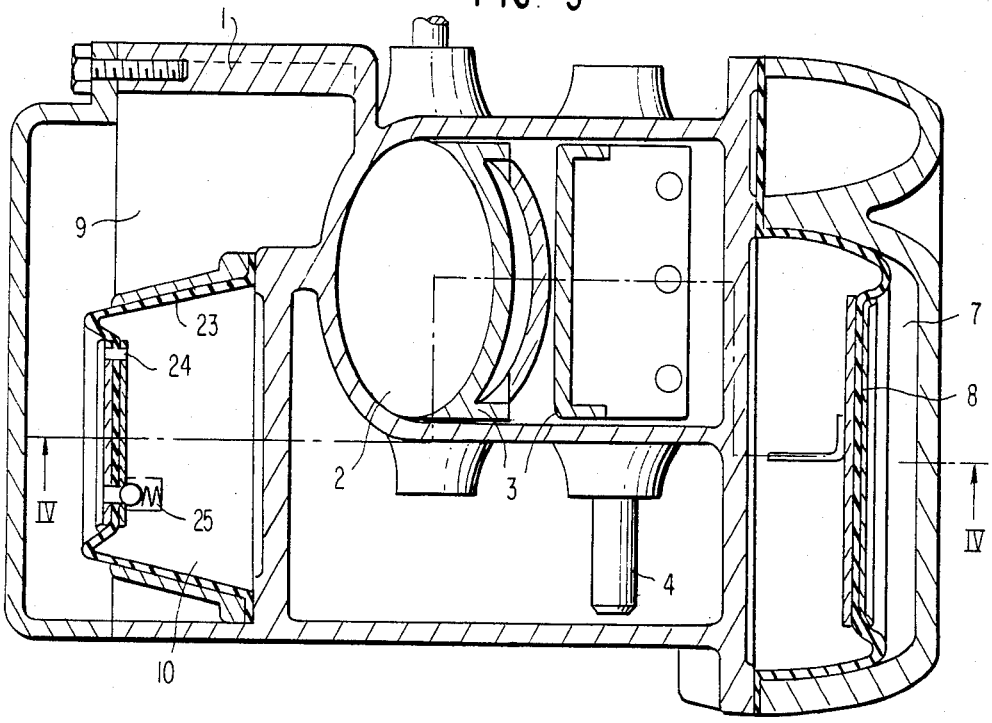
Figure 4:
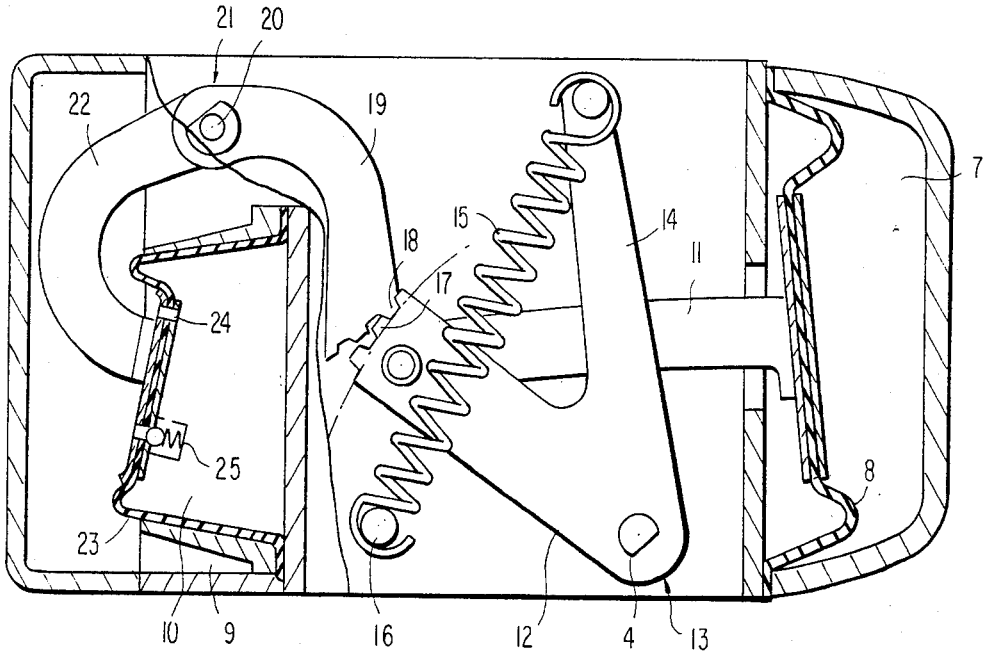

Another object of the invention is a downdraft carburetor and angular lever is provided with one leg swivellable about an axis engaging with a diaphragm of a diaphragm box, the other leg of the angular lever being provided at its free end with teeth which engage in corresponding teeth at the free end of a leg of the angular lever moving a choke tube valve, the angular lever being connected with the rod leading to the diaphragm, These and other objects, features, and advantages of the present invention will become more apparant from the following description when taken in connection with the accompanying drawings which show, for the purposes of illustration only, one embodiment in accordance with the invention, and wherein:

FIG. 1 shows a longitudinal section through the choke tube of the carburetor with open choke tube valve, FIG. 2 shows a representation in accordance with FIG. 1 with closed choke tube valve, FIG. 3 shows a section through the carburetor along the line III—III in FIG. 2 and FIG. 4 shows a section through the carburetor along the line IV—IV in FIG. 3.

Referring now to the drawings wherein like reference numerals represent like elements, the downdraft carburetor 1 of FIG. 1 is provided with a choke tube 2 which is formed in the style of a venturi nozzle. Part of the wall of the choke tube 2 is provided by a choke tube valve 3 which is connected rigidly with a shaft 4. The part, of the choke tube valve 3, completing the wall of the choke tube 2 makes up approximately half the height of the choke tube 2. In the region of the smallest cross-section of the nozzle shape of the choke tube 2, the choke tube valve 3 has a jet needle 5 connected to it, which engages in a jet carrier 6 opposite the choke tube valve 3.

The nozzle shape of the choke tube 2, visible in FIG. 1, is maintained for every position of the choke tube valve 3, even when, as shown in FIG. 2, the choke tube valve 3 takes up a closed position and almost closes off the free cross-section of the choke tube 2.

The swivelling movement of the choke tube valve 3 is controlled by a diaphragm 8 arranged in a space 7 according to FIG. 3 and this diaphragm 8 is subjected to the depression occuring in the choke tube 2 and it is damped by a damping system consisting substantially of a diaphragm box 10 placed in the float chamber 9 of the carburetor.

As is apparent in more detail from FIG. 4, the diaphragm 8 has fastened to it a rod 11 whose free end engages with the free end of the leg 12 of an angular lever 13 rigidly connected to the shaft 4. A tension spring 15, whose other end is hooked onto a screw 16, engages with the free end of the second leg 14 of the angular lever 13.

The size of the diaphragm 9, the angular lever 13, the tension spring 15 and its direction of pull are so arranged that the closing moment of the choke tube valve 3 connected to the shaft 4, FIGS. 1–3, which moment consists of the product of the spring force and the effective lever arm at any time, increases as the choke tube valve is closed. This has the effect that the flow velocity in the choke tube does not fall as the idling condition is approached, but rises. The result is an improved mixture preparation at low load and, at the same time, good volumetric efficiently at full load.

At the free end of the leg 12 of the angular lever 13, there are teeth 17 which engage in corresponding teeth 18 which are placed at the free end of one leg 19 of an angular lever 21 swivellable about an axis 20. The other leg 22 of the angular lever 21, FIG. 3, is connected to the diaphragm 23 of the diaphragm box 10 in the float chamber 9. The diaphragm 23 is provided with an orifice 24 and a self-acting non-return valve 25.

When the choke tube valve 3 is opened, FIGS. 1–3, the fuel present in the float chamber 9 and in the diaphragm box 10 is driven through the orifice 24 and this produces a damping force. When the choke tube valve is closed, the diaphragm box 10 is again filled with fuel via the non-return valve 25 and the orifice 24 without any substantial damping force. The delay in the setting movement of the choke tube valve due to damping thus occurs due to a force which is purely proportional to velocity so that no hysteresis occurs during the setting movement.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. A downdraft carburetor for internal combustiion engines, having a choke tube, a choke tube valve means, swivellable with a shaft and forming part of the choke tube wall, for controlling the magnitude of the cross-section of the choke tube, a spring-loaded diaphragm means, lever means for actuating the choke tube valve means in response to the spring loaded diaphragm means as a function of the control pressure in the choke tube a jet needle means attached to the diaphragm means for engaging a jet carrier opposite the choke tube valve, and comprising a first angular lever means rigidly connected to the shaft, rod means attached to the diaphragm means, the free end of the rod means being attached to the free end of one leg of said first angular lever means for moving the choke tube valve means, and a tension spring means for acting on another leg means of the first angular lever means for increasing the resulting closing moment due to the spring force and the effective lever arm on the closing of the choke tube valve.

2. A downdraft carburetor according to claim 1, wherein is provided a damping system connected with the first angular lever means and comprising a float chamber, a diaphragm box arranged in the float chamber, orifice means for connecting the internal space of the diaphragm box with the float chamber, and a self-acting non-return valve means for rapid filling of the diaphragm box with fuel.

3. A downdraft carburetor according to claim 2, further comprising a second angular lever means swivellable about an axis, a first leg means of said second angular lever means for engaging the diaphragm of the diaphragm box, a second leg means of the second angular lever means having teeth for engaging corresponding teeth at the free end of the one leg of the first angular lever means moving the choke tube valve, the first angular lever means being connected with the rod means leading to the diaphragm.

4. A downdraft carburetor according to claim 3, wherein the engaging teeth are provided with a plastic coating.

* * * * *